US011252502B2

(12) United States Patent
Matsuba et al.

(10) Patent No.: US 11,252,502 B2
(45) Date of Patent: Feb. 15, 2022

(54) SOUND EMITTING DEVICE, ELECTRONIC KEYBOARD MUSICAL INSTRUMENT AND SOUND EMITTING METHOD

(71) Applicant: Roland Corporation, Shizuoka (JP)

(72) Inventors: Masaaki Matsuba, Shizuoka (JP); Takahiro Murai, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 17/107,968

(22) Filed: Dec. 1, 2020

(65) Prior Publication Data

US 2021/0168499 A1 Jun. 3, 2021

(30) Foreign Application Priority Data

Dec. 3, 2019 (JP) ..... JP2019-218675

(51) Int. Cl.

| | |
|---|---|
| ***H04R 1/34*** | (2006.01) |
| ***G10H 1/34*** | (2006.01) |
| ***H04R 7/12*** | (2006.01) |
| ***H04R 1/02*** | (2006.01) |

(52) U.S. Cl.

CPC ..... *H04R 1/345* (2013.01); *G10H 1/344* (2013.01); *H04R 1/025* (2013.01); *H04R 7/12* (2013.01); *G10H 2220/221* (2013.01)

(58) Field of Classification Search

CPC ..... H04R 1/345; H04R 1/025; H04R 7/12; G10H 1/344; G10H 2220/221

See application file for complete search history.

(56) References Cited

U.S. PATENT DOCUMENTS

2013/0305899 A1* 11/2013 Nagatsuma ..... G10H 1/32 84/423 R

FOREIGN PATENT DOCUMENTS

JP 2003084768 3/2003

* cited by examiner

*Primary Examiner* — Andrew L Sniezek

(74) *Attorney, Agent, or Firm* — JCIPRNET

(57) ABSTRACT

The disclosure provides a sound emitting device includes a housing in which a corner is formed by an inner surface of a first outer wall part and an inner surface of a second outer wall part; a speaker device which includes a sound emitting part that emits a sound toward a main opening formed to penetrate through the first outer wall part and is arranged inside the housing; and a guide that is arranged between the second outer wall part and the speaker device. An auxiliary opening is provided to penetrate through the second outer wall part, and at least a part of multiple auxiliary openings is located at the same position as the sound emitting part in a length direction of the corner, and the guide includes a bottom part that projects from one of the speaker device and the second outer wall part toward the other thereof.

20 Claims, 6 Drawing Sheets

SOUND EMITTING DEVICE, ELECTRONIC KEYBOARD MUSICAL INSTRUMENT AND SOUND EMITTING METHOD

CROSS-REFERENCE TO RELATED APPLICATION

This application claims the priority benefit of Japan application no. JP 2019-218675, filed on Dec. 3, 2019. The entirety of the above-mentioned patent application is hereby incorporated by reference herein and made a part of this specification.

BACKGROUND

Technical Field

The disclosure relates to a sound emitting device, an electronic keyboard musical instrument and a sound emitting method, and specifically relates to a sound emitting device, an electronic keyboard musical instrument and a sound emitting method which can easily emit a sound propagating inside a housing to the outside.

Description of Related Art

For example, electronic musical instruments in which a speaker device having a sound emitting part such as a vibration plate or a base reflex port is arranged inside a housing are known. In an electronic keyboard musical instrument having a sound emitting device disclosed in Patent Document 1, a sound emitting part formed of a cone-shaped vibration plate is directed toward a main opening provided in a first outer wall part of a housing and an auxiliary opening is provided in a second outer wall part of the housing positioned beside the vibration plate. Therefore, while the sound emitted from the vibration plate is emitted from the main opening to the outside of the housing, the sound that is emitted from the vibration plate and propagates inside the housing can be emitted from the auxiliary opening to the outside of the housing.

Patent Documents

[Patent Document 1] Japanese Patent Laid-Open No. 2003-84768

However, if the auxiliary opening is simply provided in the second outer wall part, it is not possible to effectively emit the sound that is emitted from the sound emitting part and propagates inside the housing from the auxiliary opening to the outside.

The disclosure has been made in order to address the above problems, and the disclosure provides a sound emitting device, an electronic keyboard musical instrument and a sound emitting method which can easily emit a sound that propagates inside a housing from an auxiliary opening to the outside.

SUMMARY

The disclosure provides a sound emitting device including: a housing in which a corner is formed by an inner surface of a first outer wall part and an inner surface of a second outer wall part; a speaker device which includes a sound emitting part that emits a sound toward a main opening formed to penetrate through the first outer wall part and is arranged inside the housing; and a guide that is arranged between the second outer wall part and the speaker device, in which an auxiliary opening is provided to penetrate through the second outer wall part, and at least a part of a plurality of the auxiliary openings is located at the same position as the sound emitting part in a length direction of the corner, and the guide includes a bottom part that projects from one of the speaker device and the second outer wall part toward the other thereof.

The disclosure provides an electronic keyboard musical instrument including: a keyboard device in which a plurality of keys is arranged in a horizontal direction; a housing having a first outer wall part that is arranged on one of a rear side and an upper side of the keyboard device and a second outer wall part that is arranged on the other of the rear side and the upper side of the keyboard device; a speaker device which includes a sound emitting part that emits a sound toward a main opening formed to penetrate through the first outer wall part and is arranged inside the housing; and a guide that is arranged between the second outer wall part and the speaker device, in which an auxiliary opening is provided to penetrate through the second outer wall part, and at least a part of a plurality of the auxiliary openings is located at the same position as the sound emitting part in the horizontal direction, and the guide includes a bottom part that projects from one of the speaker device and the second outer wall part toward the other thereof.

The disclosure further provides a sound emitting method, including: providing a housing in which a corner is formed by an inner surface of a first outer wall part and an inner surface of a second outer wall part; providing a speaker device which includes a sound emitting part that emits a sound toward a main opening formed to penetrate through the first outer wall part and is arranged inside the housing; and providing a guide that is arranged between the second outer wall part and the speaker device, in which an auxiliary opening is provided to penetrate through the second outer wall part, and at least a part of a plurality of the auxiliary openings is located at the same position as the sound emitting part in a length direction of the corner, and the guide includes a bottom part that projects from one of the speaker device and the second outer wall part toward the other thereof.

DESCRIPTION OF THE EMBODIMENTS

Figure 1:
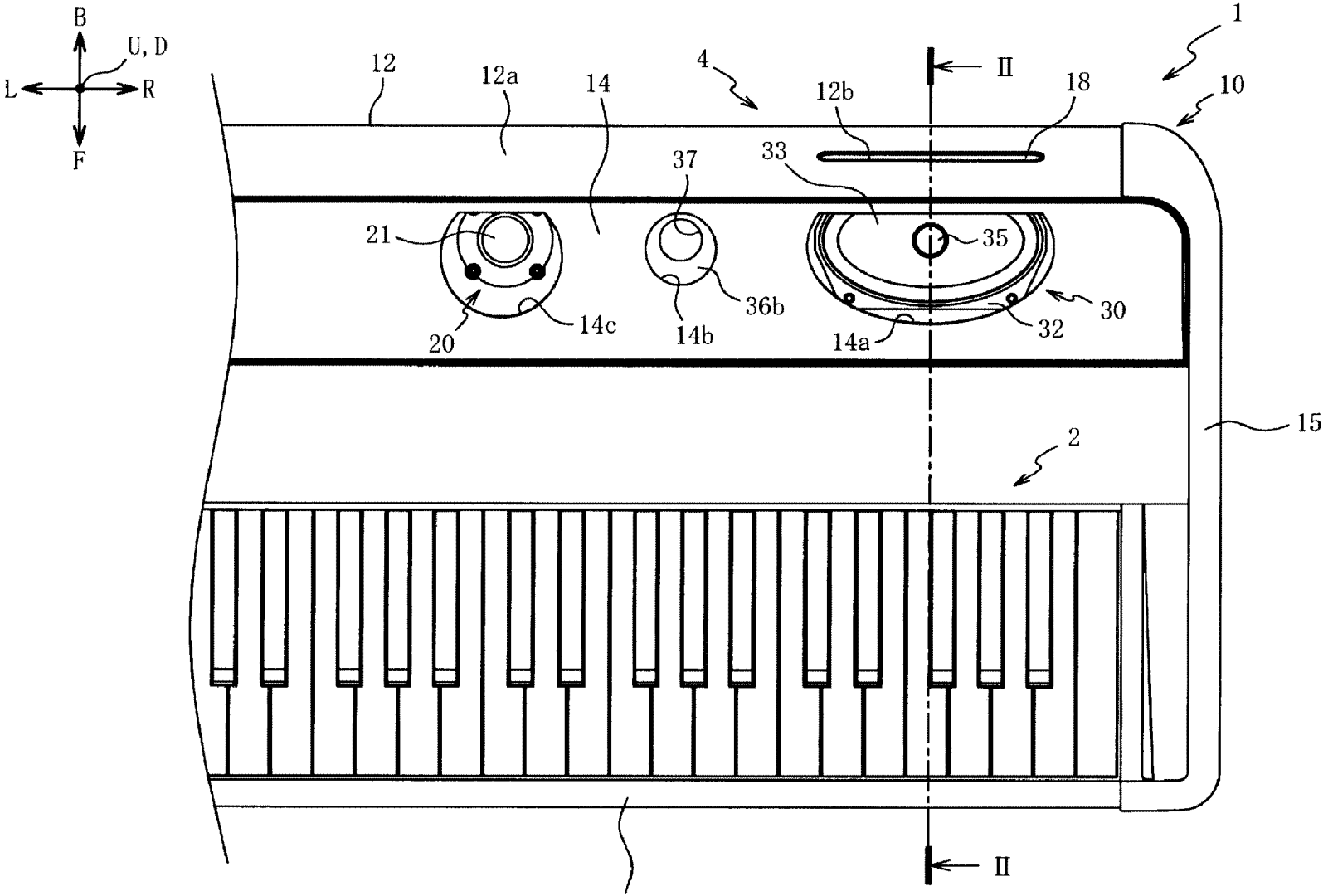
FIG. 1 is a plan view of an electronic keyboard musical instrument having a sound emitting device according to a first embodiment.
Figure 2:
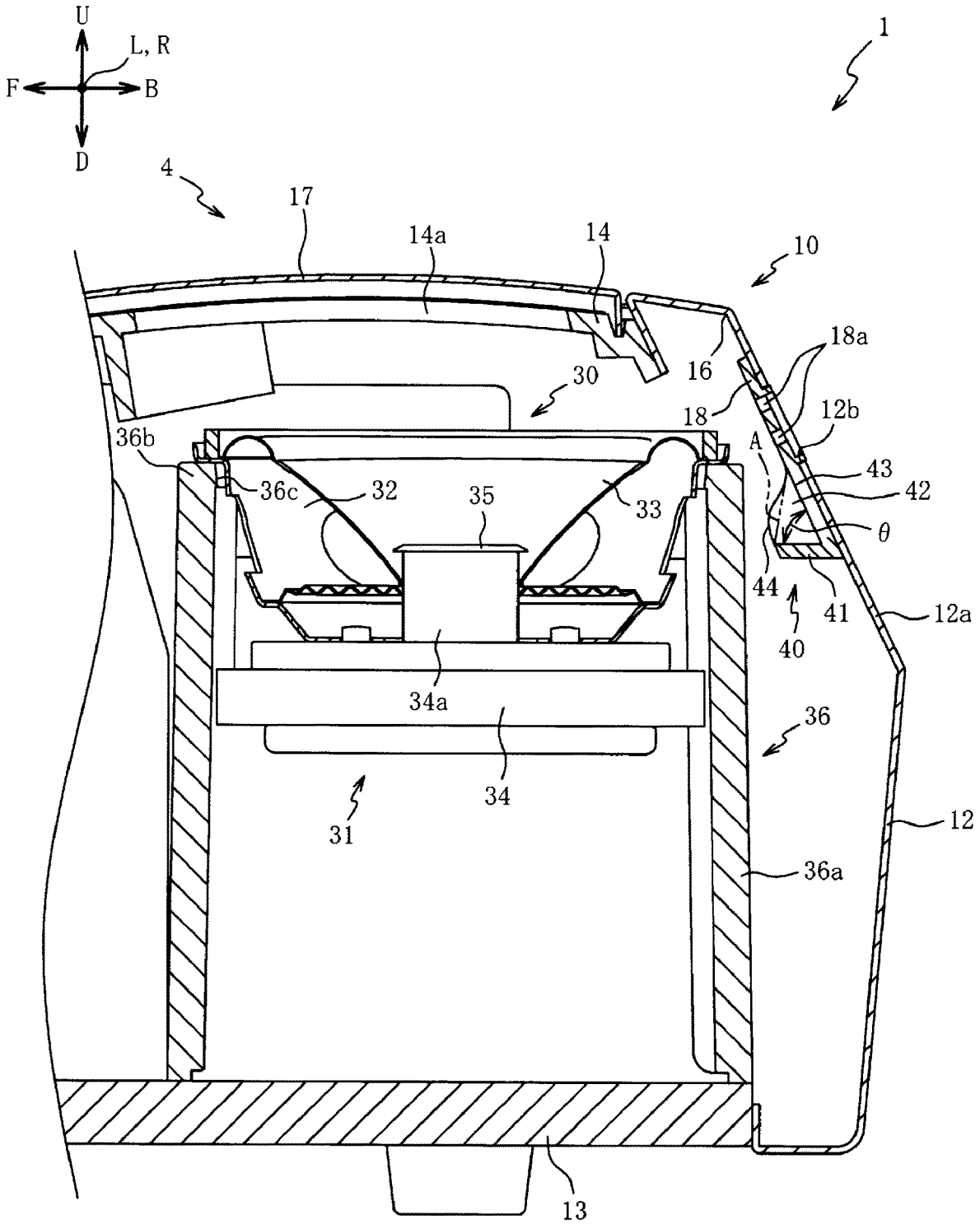
FIG. 2 is a cross-sectional view of the electronic keyboard musical instrument along the line II-II in FIG. 1.

Exemplary embodiments will be described below with reference to the appended drawings. First, an electronic keyboard musical instrument 1 will be described with reference to FIG. 1 and FIG. 2. FIG. 1 is a plan view of the electronic keyboard musical instrument 1 having a sound emitting device 4 according to a first embodiment. FIG. 2 is a cross-sectional view of the electronic keyboard musical instrument 1 along the line II-II in FIG. 1. Here, in order to simplify the drawings, in FIG. 1, a part on the right side of the electronic keyboard musical instrument 1 is shown, and a cover 17 (refer to FIG. 2) which makes it difficult to see speaker devices 20 and 30 and the like from above, and a plurality of auxiliary openings 18*a* is not shown.

In addition, in the drawings, the arrow U direction, the arrow D direction, the arrow F direction, the arrow B direction, the arrow L direction, and the arrow R direction indicate upward, downward, forward, rearward, leftward, and rightward with respect to the electronic keyboard musical instrument 1, respectively. Here, the vertical direction and the horizontal direction of the electronic keyboard musical instrument 1 are the same as the vertical direction and the horizontal direction when viewed by a player who plays the electronic keyboard musical instrument 1. On the other hand, the side of the electronic keyboard musical instrument 1 facing the player is defined as the front side.

As shown in FIG. 1, the electronic keyboard musical instrument 1 mainly includes a keyboard device 2 in which a plurality of keys is arranged in a horizontal direction (arrow L-R direction), a housing 10 that surrounds a part of the keyboard device 2 so that the plurality of keys is exposed, the speaker devices 20 and 30 that are arranged inside the housing 10 behind the keyboard device 2, and a control device (not shown) that controls a sound output from the speaker devices 20 and 30. The sound emitting device 4 includes at least the housing 10 and the speaker devices 20 and 30. The control device causes the speaker devices 20 and 30 to output a sound corresponding to an operation of each key of the keyboard device 2 performed by the player.

As shown in FIG. 1 and FIG. 2, the housing 10 includes a front panel 11, a rear panel (second outer wall part) 12, a bottom panel 13, a top panel (first outer wall part) 14, and a pair of left and right end panels 15. The front panel 11 is arranged in front of the keyboard device 2. The rear panel 12 is arranged behind the keyboard device 2 with a distance in the front to rear direction (arrow F-B direction) and faces the front panel 11 in the front to rear direction. The bottom panel 13 connects lower ends of the front panel 11 and the rear panel 12. The top panel 14 is arranged above the keyboard device 2 so that it extends from the upper end of the rear panel 12 toward the front panel 11 and covers a part of the rear side of the keyboard device 2. The end panel 15 connects both left and right ends of the front panel 11, the rear panel 12, the bottom panel 13 and the top panel 14.

The rear panel 12 includes a flat upper and rear outer wall part 12*a* that is connected to the rear edge of the top panel 14 and is provided over the whole length in the horizontal direction and a lid part 18 that is attached to the inner surface of the upper and rear outer wall part 12*a* so that it blocks a through-hole 12*b* formed to penetrate through the upper and rear outer wall part 12*a*. A corner 16 is formed by the inner surface of the upper and rear outer wall part 12*a* of the rear panel 12 and the inner surface of the top panel 14. The corner 16 is provided over the whole length of the upper and rear outer wall part 12*a* and the top panel 14 in the horizontal direction. That is, the length direction of the corner 16 is the horizontal direction of the electronic keyboard musical instrument 1.

Main openings 14*a*, 14*b*, and 14*c* which allow the inside and outside of the housing 10 to communicate with each other are formed to penetrate through the top panel 14 in the vertical direction (arrow U-D direction), and ends in the horizontal direction are arranged toward the center in order of the main openings 14*a*, 14*b*, and 14*c*. Here, actually, the main openings 14*a*, 14*b*, and 14*c* are covered with the mesh-like cover 17, which makes it difficult to see the inside of the housing 10 from the main openings 14*a*, 14*b*, and 14*c*.

The speaker device 20 is a speaker unit that has an excellent function of outputting a high-pitched sound (a sound with a frequency of 2 kHz or more in the present embodiment) and is a so-called tweeter. The speaker device 20 includes a dome-shaped vibration plate (sound emitting part) 21 having a small diameter. When a drive part (not shown) vibrates the vibration plate 21, the vibration plate 21 emits a sound to the central axis of the dome-shaped vibration plate 21 in the axial direction.

The positions of the speaker device 20 and the main opening 14*c* are set so that a sound is emitted from the vibration plate 21 toward the main opening 14*c*. In a plan view (when viewed from the central axis of the vibration plate 21 in the axial direction), the entire vibration plate 21 is housed inside the main opening 14*c*. Therefore, when a high-pitched sound having strong straightness (narrow spread from the central axis) is output from the vibration plate 21, most of the high-pitched sound emitted from the vibration plate 21 is emitted from the main opening 14*c* to the outside of the housing 10. Therefore, the high-pitched sound that is emitted from the vibration plate 21 and propagates (reflects) inside the housing 10 is reduced.

The speaker device 30 is a speaker system in which a full-range speaker unit 31 is attached to a box-shaped enclosure 36. The speaker unit 31 mainly includes a frame 32, a cone-shaped vibration plate (sound emitting part) 33, a drive part 34, and a dust cap 35.

The frame 32 supports the vibration plate 33 and the like and is formed in a substantially elliptical cone shape whose diameter increases toward the upper end. The vibration plate 33 is a member having a substantially elliptical cone shape whose diameter increases from the substantially circular lower end toward the substantially elliptical upper end, and is formed sufficiently larger than the vibration plate 21.

In a plan view (when viewed from the central axis of the vibration plate 33 in the axial direction), the frame 32 and the vibration plate 33 are formed in an elliptical shape that is long in the horizontal direction. The vibration plate 33 is arranged on the inner peripheral side of the frame 32, and the upper end of the vibration plate 33 is connected to the upper end of the frame 32. The inner peripheral surface of the cone-shaped vibration plate 33 is the front surface, and the outer peripheral surface of the vibration plate 33 that faces the frame 32 is the back surface.

The vibration plate 33 is formed in an elliptical shape in order to increase the area of the vibration plate 33 in a limited space so that a low-pitched sound can be easily output even if the speaker device 30 is attached to a compact and small space product. In particular, in the electronic keyboard musical instrument 1, the speaker device 30 is arranged between the keyboard device 2 in which a plurality of keys is arranged in the horizontal direction and which is elongated in the horizontal direction and the rear panel 12 so that a space in which the speaker device 30 is arranged is likely to be widened in the horizontal direction and is unlikely to be widened in the front to rear direction. Therefore, in the electronic keyboard musical instrument 1, it is suitable to use the elliptical vibration plate 33 that is long in the horizontal direction.

The drive part 34 is a mechanism for vibrating the vibration plate 33 in the central axis of the vibration plate 33 in the axial direction (vertical direction) and is attached to the lower end of the frame 32. The drive part 34 includes a cylindrical bobbin 34*a* that can vibrate in the central axis of the vibration plate 33 in the axial direction with respect to the frame 32 and the lower end of the vibration plate 33 is connected to the bobbin 34*a*. When the drive part 34 vibrates the vibration plate 33, a sound is mainly emitted from the front surface of the vibration plate 33 to the central axis in the axial direction. The dust cap 35 is a dome-shaped member that is arranged at the center of the front surface of the vibration plate 33 so that it covers the drive part 34.

The enclosure 36 is a box-shaped member that covers the back surface side of the vibration plate 33 so that a sound emitted from the back surface of the vibration plate 33 does not interfere with a sound emitted from the front surface of the vibration plate 33. The enclosure 36 includes a cylindrical side surface part 36*a* that rises from the bottom panel 13 and a facing surface part 36*b* that is arranged to face the bottom panel 13 and covers the upper end of the side surface part 36*a*.

The facing surface part 36*b* of the enclosure 36 and the top panel 14 are separated from and face each other in the vertical direction, and a part of the side surface part 36*a* of the enclosure 36 and the rear panel 12 are separated from and face each other in the front to rear direction. Thus, in a cross section perpendicular to the horizontal direction, a space between the facing surface part 36*b* and the top panel 14 is connected to a space between the side surface part 36*a* and the rear panel 12 (the upper and rear outer wall part 12*a*).

When a part of the speaker unit 31 is inserted into a mounting hole 36*c* provided in the facing surface part 36*b* and the upper end of the frame 32 is attached to the facing surface part 36*b*, the speaker unit 31 is attached to the enclosure 36 while the front surface of the vibration plate 33 faces the top panel 14. The positions of the vibration plate 33 and the main opening 14*a* are set so that a sound is emitted from the front surface of the vibration plate 33 toward the main opening 14*a*. Specifically, the central axis of the cone-shaped vibration plate 33 is positioned inside the main opening 14*a*.

A cylindrical base reflex port (sound emitting part) 37 that opens through the facing surface part 36*b* and extends into the enclosure 36 is provided in the facing surface part 36*b* of the enclosure 36. When air inside the enclosure 36 and air inside the base reflex port 37 are repeatedly compressed and expanded in response to a vibration in a low-pitched sound range on the back surface of the vibration plate 33, a low-pitched sound is emitted from the base reflex port 37 toward the central axis of the base reflex port 37 in the axial direction. The positions of the base reflex port 37 and the main opening 14*b* are set so that a sound is emitted from the base reflex port 37 toward the main opening 14*b*. Specifically, the central axis of the base reflex port 37 is positioned inside the main opening 14*b*.

Since a low-pitched sound emitted from the base reflex port 37 is easily diffracted, the low-pitched sound emitted from the base reflex port 37 through the main opening 14*b* is easily transmitted to both the player positioned in front of the electronic keyboard musical instrument 1 and a listener positioned behind the electronic keyboard musical instrument 1. On the other hand, the vibration plate 33 of the full-range speaker unit 31 emits not only a low-pitched sound but also a high-pitched sound that is unlikely to be diffracted. Therefore, the sound (in particular, a high-pitched sound) emitted from the vibration plate 33 through the main opening 14*a* may be easily transmitted to the player but may not be easily transmitted to the listener positioned behind the electronic keyboard musical instrument 1.

Here, in the electronic keyboard musical instrument 1, in order for a sound emitted from the vibration plate 33 to be easily transmitted to both the player and the listener, the plurality of auxiliary openings 18*a* is formed to penetrate through the rear panel 12 that faces the listener side, and a sound that is emitted from the vibration plate 33 and propagates inside the housing 10 can be emitted from the auxiliary openings 18*a*. The plurality of auxiliary openings 18*a* is formed to penetrate through the lid part 18 that blocks the through-hole 12*b* of the upper and rear outer wall part 12*a*.

The through-hole 12*b* is formed to penetrate through the upper and rear outer wall part 12*a* behind the vibration plate 33. The entire through-hole 12*b* is located at the same position as the vibration plate 33 in the horizontal direction. The plurality of auxiliary openings 18*a* is provided to penetrate through the lid part 18 inside the through-hole 12*b* so that the lid part 18 that blocks the through-hole 12*b* has a mesh shape. All of the auxiliary openings 18*a* are positioned behind the vibration plate 33 and are at the same position as the vibration plate 33 in the horizontal direction. In this manner, since the auxiliary opening 18*a* is positioned near the vibration plate 33, a sound that is emitted from the vibration plate 33 and propagates inside the housing 10 can be easily emitted from the auxiliary opening 18*a* to the outside.

The horizontal length of the range in which the plurality of auxiliary openings 18*a* is formed (the through-hole 12*b*) and the horizontal length of the vibration plate 33 are substantially the same, and the center position of the range in which the plurality of auxiliary openings 18*a* is formed and the vibration plate 33 in the horizontal direction is the same position in the horizontal direction. In addition, when viewed in the front to rear direction, a range in which the plurality of auxiliary openings 18*a* is formed overlaps the vibration plate 33. Therefore, the sound emitted from the auxiliary opening 18*a* can spread to both left and right sides by the same amount.

In the lid part 18 in which the auxiliary opening 18*a* is provided, a guide 40 is integrally molded with a part below the auxiliary opening 18*a*. The guide 40 allows a sound that propagates inside the housing 10 to be easily emitted from the auxiliary opening 18*a*.

Figure 3:
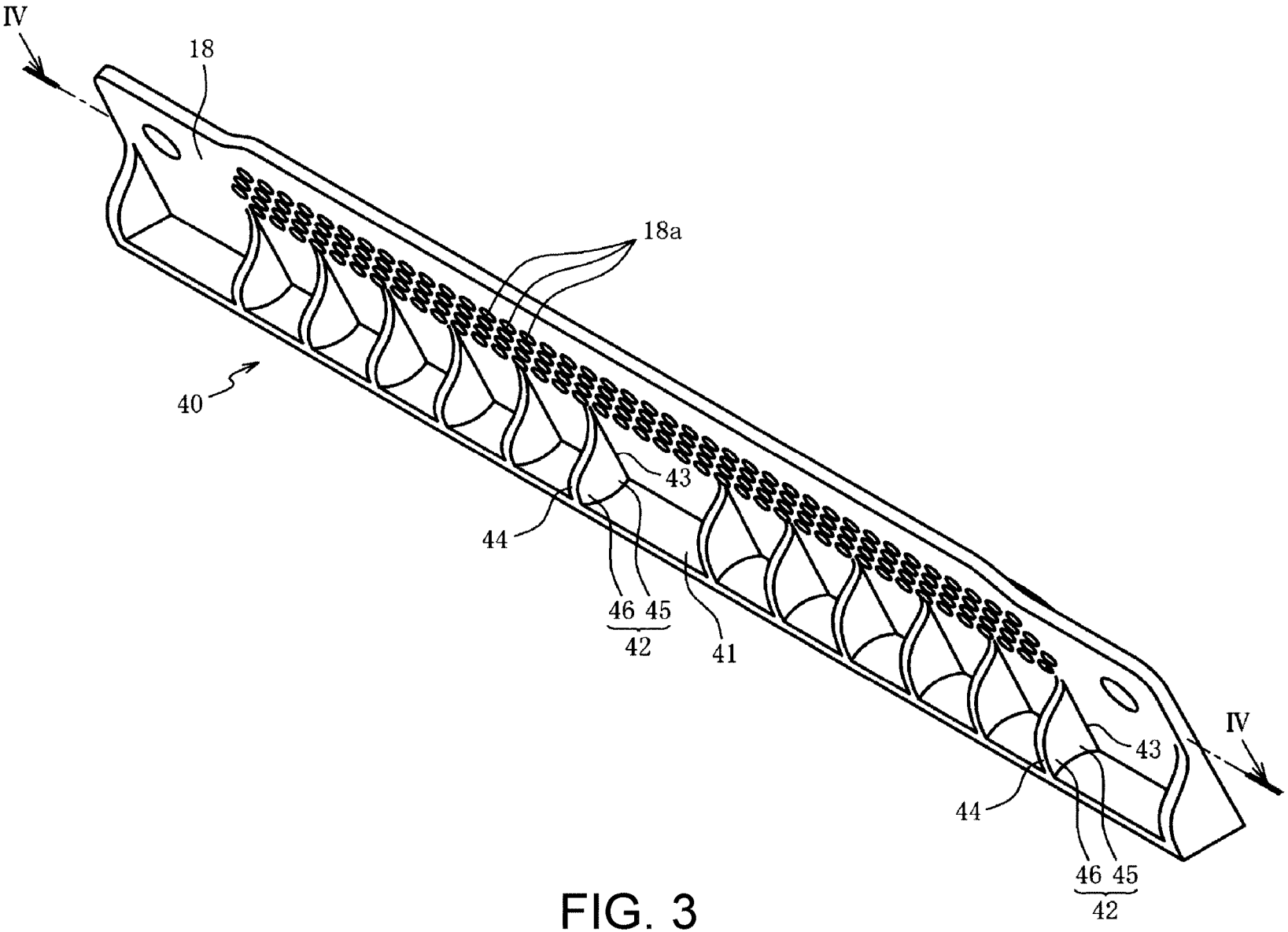
FIG. 3 is a perspective view of a guide and a lid part.
Figure 4:
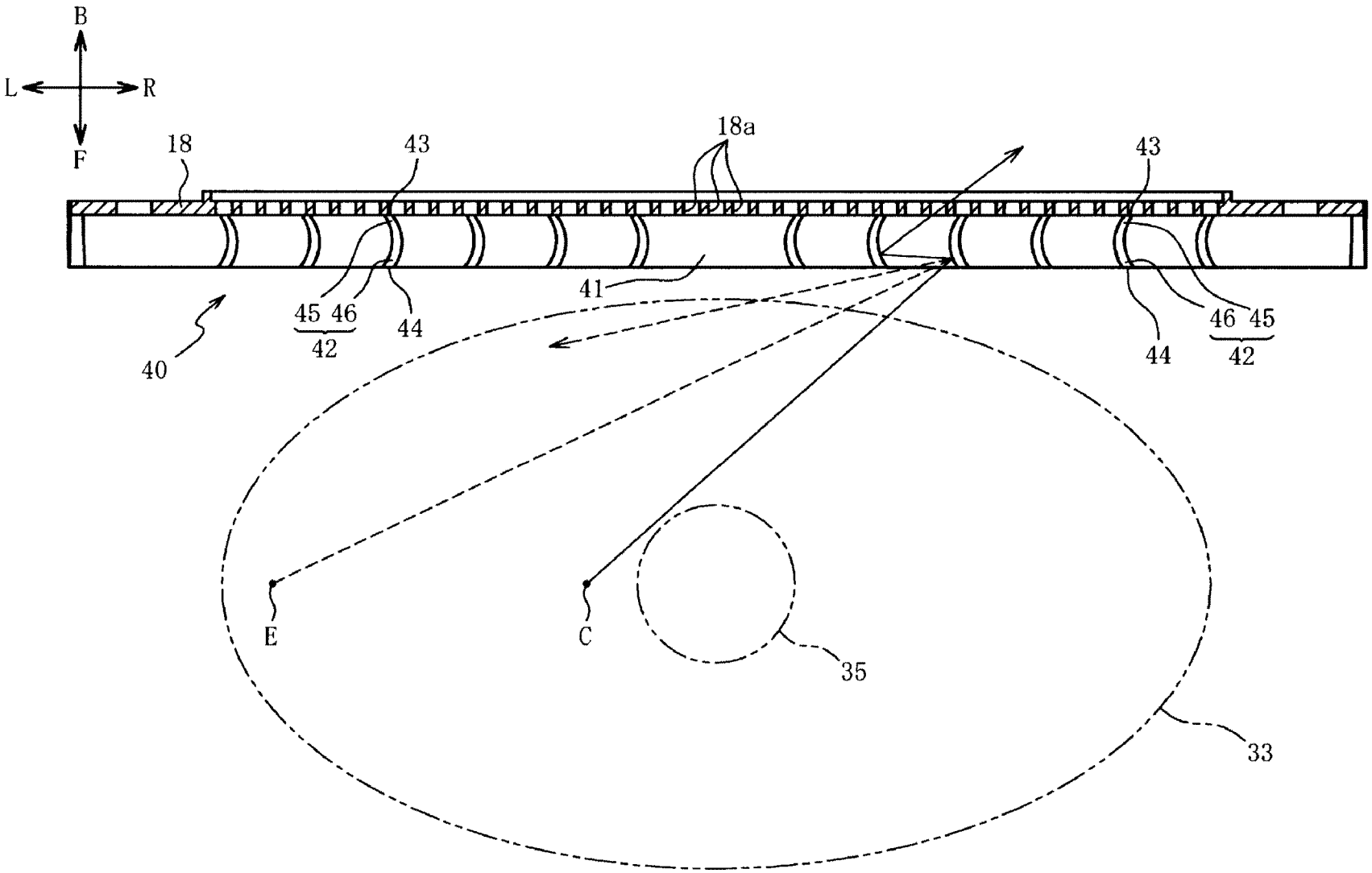
FIG. 4 is a cross-sectional view of the guide and the lid part along the line IV-IV in FIG.

The guide 40 will be described with reference to FIG. 3 and FIG. 4 in addition to FIG. 2. FIG. 3 is a perspective view of the guide 40 and the lid part 18. FIG. 4 is a cross-sectional view of the guide 40 and the lid part 18 along the line IV-IV in FIG. 3. FIG. 4 shows a cross section perpendicular to the lid part 18, and outlines of the vibration plate 33 and the dust cap 35 are indicated by a two-dot-dashed line.

As shown in FIG. 2 and FIG. 3, the guide 40 includes a bottom part 41 that projects from the lower edge of the lid part 18 toward the speaker device 30 and a plurality of diffusion parts 42 that rise from the bottom part 41 toward the auxiliary opening 18*a* of the lid part 18. The bottom part 41 is provided over the whole length of the lower edge of the lid part 18 and is formed to extend in the horizontal direction. The horizontal length of the bottom part 41 is longer than the horizontal length of the range in which the auxiliary openings 18*a* are formed.

The bottom part 41 is formed in a flat plate shape perpendicular to the vertical direction. In a cross section perpendicular to the horizontal direction, the angle θ formed by the bottom part 41 and the inner surface of the lid part 18 (a plane including the inner peripheral edge of the auxiliary opening 18*a* inside the housing 10) is less than 90°. The bottom part 41 is provided below the upper end of the facing surface part 36*b* or the vibration plate 33 (at a position away from the top panel 14). The width of the bottom part 41 in the front to rear direction is set so that it does not interfere with the speaker device 30 and the like when the electronic keyboard musical instrument 1 is assembled.

As shown in FIG. 2 to FIG. 4, the plurality of diffusion parts 42 is parts that divide the space inside the housing 10 between the bottom part 41 and the auxiliary opening 18*a* in the horizontal direction and are arranged in the horizontal direction. The plurality of diffusion parts 42 extend straight from the bottom part 41 in a direction parallel to the lid part 18. Therefore, the guide 40 having the bottom part 41 and the diffusion part 42 can be easily molded by a mold that is divided into two parts in a direction parallel to the lid part 18.

The diffusion part 42 includes a first end 43 on the side of the lid part 18, a second end 44 on the side of the speaker device 30, a first inclined part 45 that extends from the first end 43 toward the second end 44, and a second inclined part 46 provided between the second end 44 and the first inclined part 45. The entire first end 43 is connected to the lid part 18. The upper end of the first end 43 is located at substantially the same position as the lower edge of the lowermost auxiliary opening 18*a*. The second end 44 is a part farthest from the lid part 18 in a direction perpendicular to the lid part 18. The second end 44 of the diffusion part 42 projects toward the speaker device 30 from an imaginary line A connecting the upper end of the first end 43 and the tip (the end away from the lid part 18) of the bottom part 41.

The first inclined part 45 is a part that is inclined so that it is curved toward the center (the dust cap 35) of the vibration plate 33 in the horizontal direction toward the second end 44 from the first end 43. The second inclined part 46 is a part that is inclined so that it is curved toward the center of the vibration plate 33 in the horizontal direction toward the first end 43 from the second end 44. In a direction perpendicular to the lid part 18, a part from the first end 43 to substantially the center of the diffusion part 42 is the first inclined part 45, and a part from the second end 44 to substantially the center of the diffusion part 42 is the second inclined part 46.

In the present embodiment, all of the diffusion parts 42 have such a first inclined part 45 and second inclined part 46 and are arranged in the horizontal direction.

According to the electronic keyboard musical instrument 1 (the sound emitting device 4) described above, the bottom part 41 projects from the lid part 18 of the rear panel 12 toward the speaker device 30, and the auxiliary opening 18*a* is positioned between the bottom part 41 and the top panel 14. Therefore, a sound that would otherwise propagate below the auxiliary opening 18*a* inside the housing 10 without being emitted from the vibration plate 33 through the auxiliary opening 18*a* can be reflected by the bottom part 41 and easily directed toward the auxiliary opening 18*a*. As a result, the sound that propagates inside the housing 10 can be easily emitted from the auxiliary opening 18*a*, and the same sound that is transmitted to the player from the main opening 14*a* that the vibration plate 33 faces can be easily transmitted to the listener whom the rear panel 12 faces.

Since the horizontal length of the bottom part 41 is longer than the horizontal length of the range in which the plurality of auxiliary openings 18*a* is formed, a sound that propagates in the vicinity of the auxiliary opening 18*a* inside the housing 10 can be easily applied to the bottom part 41. Therefore, the sound that propagates inside the housing 10 can be reflected by the bottom part 41 and more easily emitted from the auxiliary opening 18*a*.

Since the angle θ formed by the bottom part 41 and the inner surface of the lid part 18 is less than 90°, the bottom part 41 faces the auxiliary opening 18*a* provided in the lid part 18. Therefore, the sound reflected by the bottom part 41 can be easily directed toward the auxiliary opening 18*a*, and the sound that propagates inside the housing 10 can be more easily emitted through the auxiliary opening 18*a*.

Preferably, the bottom part 41 is not in the shortest path for the sound that is emitted from the vibration plate 33 toward the auxiliary opening 18*a*, and is positioned on the side opposite to the shortest path with respect to the auxiliary opening 18*a*. Therefore, the sound that passes through the shortest path from the vibration plate 33 toward the auxiliary opening 18*a* is not attenuated by hitting the bottom part 41, the sound that passes through the shortest path can be emitted from the auxiliary opening 18*a*, and the sound that is not directed toward the auxiliary opening 18*a* can be reflected by the bottom part 41 and easily directed toward the auxiliary opening 18*a*.

Here, since the vibration plate 33 vibrates up and down due to the drive part 34, the sound is emitted not only from the front surface of the vibration plate 33 that faces the main opening 14*a* but also from the back surface of the vibration plate 33. Therefore, for example, as in Patent Document 1 (Japanese Patent Laid-Open No. 2003-84768) described above, a configuration in which the sound emitted from the front surface of the vibration plate 33 is mainly emitted from the main opening 14*a* and the sound emitted from the back surface of the vibration plate 33 is mainly emitted from the auxiliary opening 18*a* may be used or a configuration in which the sound is easily emitted from the auxiliary opening 18*a* by the guide 40 may be used. However, in this case, since the phase of the sound emitted from the front surface of the vibration plate 33 is opposite to the phase of the sound emitted from the back surface of the vibration plate 33, if the sound emitted from the main opening 14*a* and the sound emitted from the auxiliary opening 18*a* cannot be appropriately separated, these sounds may cancel each other.

On the other hand, in the present embodiment, since the vibration plate 33 is provided on the facing surface part 36*b* of the box-shaped enclosure 36 and the vibration plate 33 divides the inside and outside of the enclosure 36, the sound emitted from the back surface of the vibration plate 33 is unlikely to be emitted to the outside of the enclosure 36. Then, in a cross section perpendicular to the horizontal direction, a space between the facing surface part 36*b* and the top panel 14 is connected to a space between the side surface part 36*a* and the rear panel 12, and the main opening 14*a* and the auxiliary opening 18*a* communicate with each other via the inside of the housing 10.

Therefore, the sound emitted from the front surface of the vibration plate 33 toward the main opening 14*a* propagates inside the housing 10 toward the auxiliary opening 18*a*, and the sound emitted from the front surface of the vibration plate 33 can be emitted from the auxiliary opening 18*a*. That is, since the sound having the same phase as the sound emitted from the main opening 14*a* can be emitted from the auxiliary opening 18*a*, it is possible to prevent these sounds from interfering with each other and canceling each other.

In addition, since the enclosure 36 makes it difficult for the sound emitted from the back surface of the vibration plate 33 to propagate inside the housing 10, when the sound emitted from the front surface of the vibration plate 33 is transmitted toward the auxiliary opening 18*a*, it is possible to prevent the sound emitted from the back surface of the vibration plate 33 and the sound emitted from the front surface of the vibration plate 33 from canceling each other inside the housing 10. As a result, it is possible to secure the sound pressure level of the sound emitted from the auxiliary opening 18*a*.

Here, in order to prevent the sound emitted from the main opening 14*a* and the sound emitted from the auxiliary opening 18*a* from interfering with each other and canceling each other, it is necessary to arrange the speaker device 30 having the enclosure 36 inside the housing 10 in which the main opening 14*a* and the auxiliary opening 18*a* are provided, but the guide 40 is not essential.

When the guide 40 is provided, it is preferable that the bottom part 41 be provided at a position away from the top panel 14 with respect to the upper end of the facing surface part 36*b* and the vibration plate 33. Therefore, the sound that is emitted from the front surface of the vibration plate 33 and is transmitted around a space between the side surface part 36*a* of the enclosure 36 and the rear panel 12 can be easily reflected by the bottom part 41 and directed toward the auxiliary opening 18*a*.

In addition, in a cross section (cross section in FIG. 2) perpendicular to the horizontal direction including the vibration plate 33 and the auxiliary opening 18*a*, when the main opening 14*a* and the auxiliary opening 18*a* communicate with each other inside the housing 10, at least a part of the auxiliary openings 18*a* are preferably positioned (on the side of the top panel 14) above the upper end of the vibration plate 33. Therefore, a part of the sound emitted from the front surface of the vibration plate 33 can be easily directly propagated to the auxiliary opening 18*a* without being reflected and attenuated by the inner surface of the housing 10 and the like.

As a result, it is possible to secure the sound pressure level of the sound emitted from the auxiliary opening 18*a*.

A part of the vibration plate 33 and a part of the top panel 14 behind (on the side of the upper and rear outer wall part 12*a*) the main opening 14*a* face each other with respect to the central axis of the vibration plate 33 in the axial direction. Therefore, the sound emitted from the front surface of the vibration plate 33 is reflected by the top panel 14 and the sound easily propagates inside the housing 10. As a result, the sound emitted from the front surface of the vibration plate 33 can be more easily emitted from the auxiliary opening 18*a*.

Since the plurality of diffusion parts 42 of the guide 40 divide a space between the bottom part 41 and the auxiliary opening 18*a* in the horizontal direction, the sound toward the bottom part 41 and the sound reflected by the bottom part 41 can be reflected by the plurality of diffusion parts 42. Therefore, since the sound that propagates inside the housing 10 is easily irregularly reflected, the sound that propagates inside the housing 10 can be easily guided to the auxiliary opening 18*a* and the sound can be easily emitted from the auxiliary opening 18*a*.

Since the second end 44 of the diffusion part 42 on the side of the speaker device 30 projects closer to the speaker device 30 than the imaginary line A connecting the upper end of the first end 43 and the tip of the bottom part 41, the sound that propagates inside the housing 10 can be easily applied to the diffusion part 42. Therefore, the sound irregularly reflected by the diffusion part 42 can be easily guided to the auxiliary opening 18*a*.

Since the diffusion part 42 is not perpendicular to the lid part 18 but is inclined in the horizontal direction by the first inclined part 45 and the second inclined part 46, the sound directed rearward from the vibration plate 33 (the side of the auxiliary opening 18*a*) can be easily reflected by the diffusion part 42 in the horizontal direction. Since the sound that propagates inside the housing 10 can be more easily irregularly reflected by the first inclined part 45 and the second inclined part 46, the sound that propagates inside the housing 10 can be easily emitted from the auxiliary opening 18*a*.

Here, the plurality of diffusion parts 42 is not provided behind the dust cap 35 (at the same position as the dust cap 35 in the horizontal direction). This is because, since inclination directions of the first inclined part 45 and the second inclined part 46 of the plurality of diffusion parts 42 are reversed based on the center of the vibration plate 33 in the horizontal direction, that is, the dust cap 35, when the diffusion part 42 is provided behind the dust cap 35, it is difficult for the diffusion part 42 to be formed inclined toward both sides in the horizontal direction.

Since the first inclined part 45 is inclined toward the center of the vibration plate 33 in the horizontal direction from the first end 43 toward the second end 44, the sound that is reflected by the first inclined part 45 and directed toward the auxiliary opening 18*a* can be easily spread to both sides in the horizontal direction. As a result, the sound emitted from the auxiliary opening 18*a* can be easily spread in the horizontal direction.

In the vibration plate 33 having an elliptical shape that is long in the horizontal direction, the end in the horizontal direction with respect to the central part in the horizontal direction is likely to be divided and vibrated, and the sound emitted from the divided and vibrated end in the horizontal direction may be heard as an abnormal sound. As shown in FIG. 4, a part closer to the center in the horizontal direction, which is a part on the left side of the vibration plate 33, is defined as a central part C, and a part close to the edge in the horizontal direction is defined as an end E for description, but the same would apply if the left and right were reversed. In addition, a predetermined path for the sound toward the diffusion part 42 on the right side of the center of the vibration plate 33 from the central part C is indicated by a solid line arrow, and a predetermined path for the sound toward the diffusion part 42 on the right side from the end E is indicated by a dashed line arrow.

The second inclined part 46 is inclined toward the center of the vibration plate 33 in the horizontal direction from the second end 44 toward the first end 43. Therefore, the angle of incidence of the sound that enters the second inclined part 46 of the diffusion part 42 on the right side from the end E is smaller than the angle of incidence of the sound that enters the second inclined part 46 of the diffusion part 42 on the right side from the central part C. Then, the sound that is emitted from the central part C and reflected by the second inclined part 46 is easily directed to the auxiliary opening 18*a*, and the sound that is emitted from the end E and reflected by the second inclined part 46 is not easily directed to the auxiliary opening 18*a*.

In addition, since the plurality of diffusion parts 42 is arranged in the horizontal direction, the sound that would otherwise enter the first inclined part 45 of a specific diffusion part 42 on the right side from the end E is easily blocked by the diffusion part 42 closer to the end E than the specific diffusion part 42. The same applies for the sound emitted from the central part C, but when the distance in the horizontal direction from the position at which the sound is emitted to the specific diffusion part 42 is longer, the sound is blocked by the diffusion part 42 in front thereof and is unlikely to enter the first inclined part 45. Therefore, the sound emitted from the end E on the left side is less likely to be reflected by the first inclined part 45 of the diffusion part 42 on the right side and more easily reflected by the second inclined part 46 than the sound emitted from the central part C. Therefore, since the sound emitted from the end of the vibration plate 33 in the horizontal direction, which is easily divided and vibrated, can be made less likely to be guided to the auxiliary opening 18*a* by the second inclined part 46, it is possible to prevent an abnormal sound resulting from this dividing and vibrating from being emitted from the auxiliary opening 18*a*.

The diffusion part 42 is preferably positioned not in the shortest path for the sound that is emitted from the vibration plate 33 toward the auxiliary opening 18*a* but on the side opposite to the shortest path with respect to the auxiliary opening 18*a*. Therefore, the sound that is directed toward the auxiliary opening 18*a* through the shortest path from the vibration plate 33 is not attenuated by hitting the diffusion part 42 and the sound can be emitted from the auxiliary opening 18*a*, and the sound that is not directed toward the auxiliary opening 18*a* can be irregularly reflected by the diffusion part 42 and easily directed toward the auxiliary opening 18*a*.

Figure 5A:
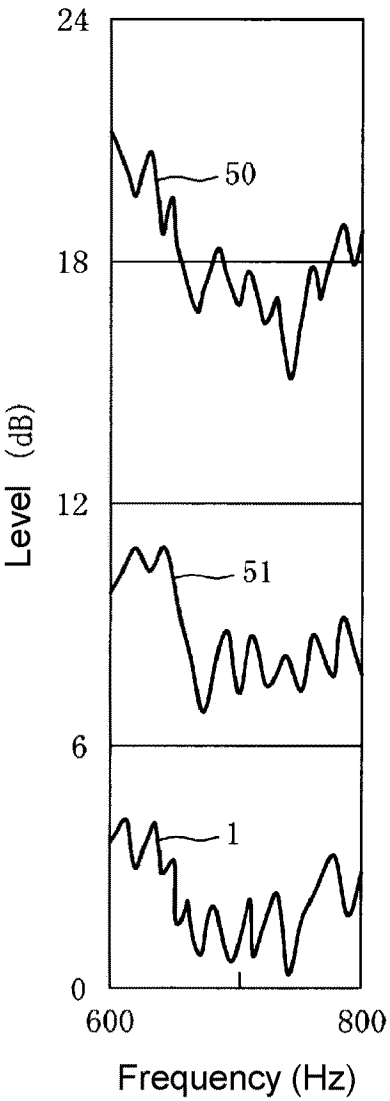
FIG. 5A to FIG. 5D are graphs showing frequency characteristics of the electronic keyboard musical instrument.
Figure 5B:
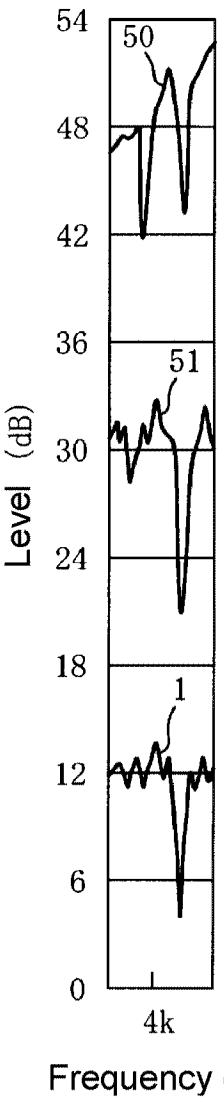
Figure 5C:
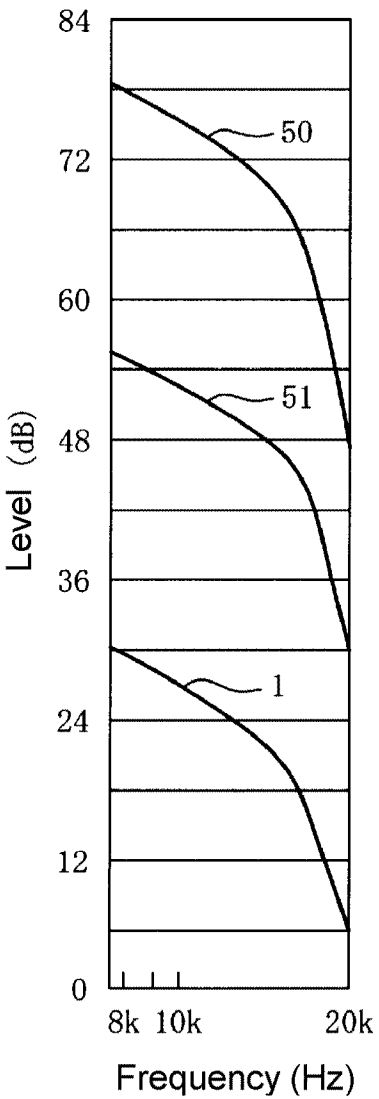
Figure 5D:
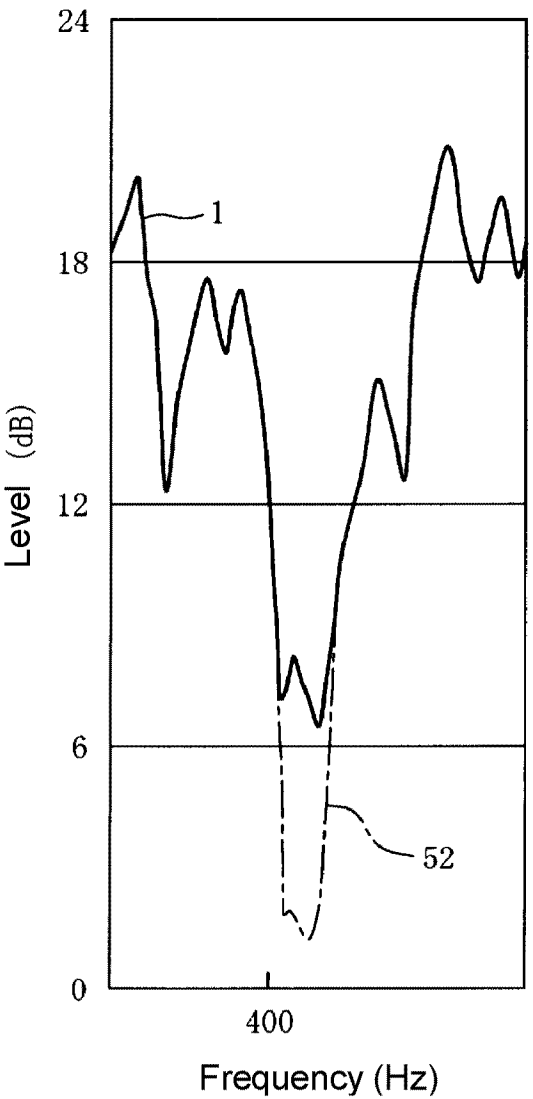

Next, using the graphs of the frequency characteristics in FIG. 5A to FIG. 5D, descriptions of effects of compositions of respective parts of the electronic keyboard musical instrument 1 described above will be supplemented. FIG. 5A to FIG. 5C show frequency characteristics of the electronic keyboard musical instrument 1, frequency characteristics of an electronic keyboard musical instrument 50 in which the auxiliary opening 18*a* and the guide 40 are removed from the electronic keyboard musical instrument 1, and frequency characteristics of an electronic keyboard musical instrument 51 in which only the guide 40 is removed from the electronic keyboard musical instrument 1. FIG. 5D shows frequency characteristics of the electronic keyboard musical instrument 1 and frequency characteristics of an electronic keyboard musical instrument 52 in which diffusion parts are formed perpendicular to the lid part 18 with respect to the electronic keyboard musical instrument 1. The frequency characteristics of the electronic keyboard musical instruments 1, 50, 51, and 52 are measurement results obtained by measuring the sound pressure level at the same position behind the electronic keyboard musical instruments 1, 50, 51, and 52.

In the graphs, the horizontal axis represents frequency (Hz) and a logarithmic scale is used. In the graphs, the vertical axis represents a sound pressure level (dB) which is a relative level with respect to an arbitrary reference value. In FIG. 5A to FIG. 5C, respective reference values are different from each other so that the graphs for the electronic keyboard musical instruments 1, 50, and 51 do not overlap. In addition, in FIG. 5C, in order to simplify the drawings, the attenuation curve is schematically shown by smoothly connecting a plurality of peak values of the sound pressure level.

In FIG. 5A and FIG. 5B, it can be understood that, compared to the electronic keyboard musical instrument 50 in which the auxiliary opening 18*a* is not provided, in the electronic keyboard musical instruments 1 and 51 in which the auxiliary opening 18*a* is provided, vertical fluctuation of the sound pressure level at 600 to 800 Hz is inhibited and downward fluctuation of the sound pressure level in a frequency band slightly lower than 4 kHz is inhibited. In addition, it can be understood that, compared to the electronic keyboard musical instrument 51 in which the guide 40 is not provided, in the electronic keyboard musical instrument 1 in which the guide 40 is provided, vertical fluctuation of the sound pressure level at 600 to 700 Hz is further inhibited, there is no significant downward fluctuation of the sound pressure level in a frequency band slightly lower than 4 kHz, and downward fluctuation of the sound pressure level in a frequency band slightly higher than 4 kHz is inhibited.

In FIG. 5C, it can be understood that, from around 8*k* Hz to 20 kHz, the level is lowered by about 30 dB in the electronic keyboard musical instrument 50 in which the auxiliary opening 18*a* and the guide 40 are not provided, the level is lowered by about 26 dB in the electronic keyboard musical instrument 51 in which the auxiliary opening 18*a* is provided and the guide 40 is not provided, and the level is lowered by about 24 dB in the electronic keyboard musical instrument 1 in which the auxiliary opening 18*a* and the guide 40 are provided.

Based on these results, it can be clearly understood that, when the auxiliary opening 18*a* is provided, it is possible to inhibit vertical fluctuation of the sound pressure level and prevent the sound in a specific frequency band from becoming difficult to hear, and it is possible to make it difficult to attenuate a high-pitched sound range and make a high-pitched sound easy to hear. In addition, it can be clearly understood that, when the guide 40 is provided in addition to the auxiliary opening 18*a*, vertical fluctuation of the sound pressure level is further inhibited and it is possible to further prevent the sound in a specific frequency band from becoming difficult to hear, and it is possible to make it more difficult to attenuate a high-pitched sound range and make a high-pitched sound more easy to hear.

In FIG. 5D, it can be understood that, compared to the electronic keyboard musical instrument 52 in which the diffusion parts are formed perpendicular to the lid part 18, in the electronic keyboard musical instrument 1 in which the diffusion part 42 is inclined with respect to the lid part 18, downward fluctuation of the sound pressure level at about 400 Hz is inhibited. Therefore, it can be clearly understood that, when the diffusion part 42 is inclined with respect to the lid part 18, vertical fluctuation of the sound pressure level is inhibited and it is possible to prevent the sound in a specific frequency band from becoming difficult to hear.

Figure 6:
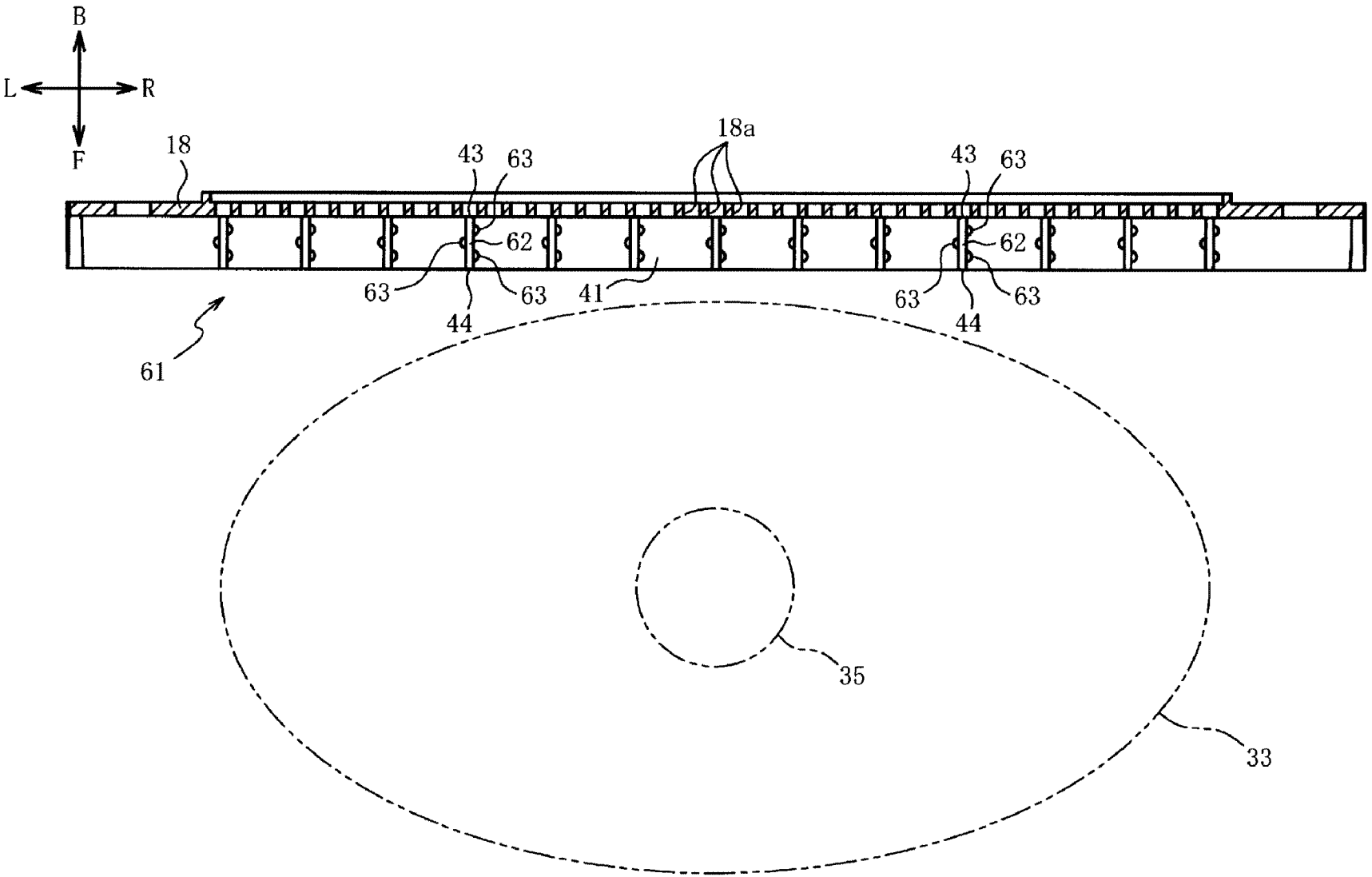
FIG. 6 is a cross-sectional view of a guide and a lid part used in a sound emitting device according to a second embodiment.

Next, a second embodiment will be described with reference to FIG. 6. A case in which the diffusion part 42 is inclined with respect to the lid part 18 has been described in the first embodiment. On the other hand, a case in which a diffusion part 62 is formed perpendicular to the lid part 18 and a plurality of protrusions 63 is provided on both left and right surfaces of the diffusion part 62 will be described in the second embodiment. Here, the same components as those described in the first embodiment will be denoted with the same references numerals and will not be described below. FIG. 6 is a cross-sectional view of a guide 61 and the lid part 18 used in a sound emitting device (electronic keyboard musical instrument) in the second embodiment. FIG. 6 shows a cross section perpendicular to the lid part 18, and outlines of the vibration plate 33 and the dust cap 35 are indicated by a two dots-dashed line.

As shown in FIG. 6, the guide 61 includes the bottom part 41, and a plurality of diffusion parts 62 that rise from the bottom part 41 toward the auxiliary opening 18*a* of the lid part 18. The plurality of diffusion parts 62 is parts that divide a space between the bottom part 41 and the auxiliary opening 18*a* in the horizontal direction, and are arranged in the horizontal direction.

As in the electronic keyboard musical instrument 1 in the first embodiment, in such an electronic keyboard musical instrument (sound emitting device) including the guide 61, the sound that would otherwise be emitted from the vibration plate 33 and propagate below the auxiliary opening 18*a* (the rear side of the plane of the paper in FIG. 6) without being emitted from the auxiliary opening 18*a* can be reflected by the bottom part 41 and easily directed toward the auxiliary opening 18*a*. As a result, the sound that propagates inside the housing 10 (refer to FIG. 1) can be easily emitted from the auxiliary opening 18*a*.

The diffusion part 62 is formed perpendicular to the bottom part 41 over the whole length from the first end 43 on the side of the lid part 18 to the second end 44 on the side of the speaker device 30. The plurality of protrusions 63 is provided on both left and right surfaces of the diffusion part 62. Therefore, when the sound that propagates inside the housing 10 enters the diffusion part 62, the direction in which the sound is reflected tends to differ depending on whether it enters the protrusion 63 or the position at which it enters the protrusion 63. As a result, since the sound that propagates inside the housing 10 can be easily irregularly reflected by the diffusion part 62, the sound that propagates inside the housing 10 can be easily emitted from the auxiliary opening 18*a*.

While the disclosure has been described above with reference to the embodiments, the disclosure is not limited to the above embodiments, and it can be easily inferred that various improvements and modifications can be made without departing from the spirit and scope of the disclosure. For example, the sound emitting device described in the above embodiment may be applied for not only the sound emitting device 4 provided in the electronic keyboard musical instrument 1, but also devices in which a speaker device is mounted in a housing such as other electronic musical instruments and audio devices, and portable devices. In addition, the vibration plate 33 may have a substantially circular shape. In addition, for example, the position of the bottom part 41 may be appropriately set based on experiments or analysis so that the sound emitted from the vibration plate 33 can be reflected by the bottom part 41 and easily guided to the auxiliary opening 18*a* without limitation to a case in which the auxiliary opening 18*a* is positioned between the bottom part 41 and the top panel 14.

While a case in which the main opening 14*a* is provided in the top panel 14, the front surface of the vibration plate 33 faces the main opening 14*a*, and the auxiliary opening 18*a* is provided in the rear panel 12 has been described in the above embodiment, the disclosure is not necessarily limited thereto. Depending on the type of the housing, a main opening may be provided on the first outer wall part of the housing, the front surface of the vibration plate 33 may face the main opening, and an auxiliary opening may be provided in the second outer wall part which forms a corner with the first outer wall part. That is, the disclosure is not limited to a case in which the top panel 14 is used as the first outer wall part and the rear panel 12 is used as the second outer wall part, and for example, the rear panel 12 may be used as the first outer wall part and the top panel 14 may be used as the second outer wall part. In addition, the end panel 15 may be used as the first outer wall part or the second outer wall part.

While a case in which the auxiliary opening 18*a* is located at the same position as the vibration plate (sound emitting part) 33 in the horizontal direction and the sound that is emitted from the vibration plate 33 and propagates inside the housing 10 is emitted from the auxiliary opening 18*a* has been described in the above embodiment, the disclosure is not necessarily limited thereto. A configuration in which the vibration plate 21 of the speaker device 20, which is a tweeter, the base reflex port 37 or the like is used as the sound emitting part and the auxiliary opening 18*a* is located at the same position as the sound emitting part in the horizontal direction may be used. Therefore, the sound that is emitted from the sound emitting part such as the vibration plate 21 or the base reflex port 37 and propagates inside the housing 10 can be easily emitted from the auxiliary opening 18*a*.

Here, since the sound emitted from the base reflex port 37 is a low-pitched sound that is easily diffracted, even if the auxiliary opening 18*a* is not provided near the base reflex port 37, the sound that is emitted from the base reflex port 37 through the main opening 14*b* is easily transmitted to both front and rear sides of the electronic keyboard musical instrument 1. When the auxiliary opening 18*a* is provided near the base reflex port 37, since the sound that is emitted from the base reflex port 37 becomes a complicated echo sound inside the housing 10 and is emitted from the auxiliary opening 18*a* depending on the propagation path from the base reflex port 37 to the auxiliary opening 18*a*, it is necessary to set the propagation path correctly.

In addition, when the vibration plate 21 which is the tweeter which mainly emits a high-pitched sound of 2 kHz or more is used, the high-pitched sound emitted from the vibration plate 21 is unlikely to be diffracted, but it has strong straightness and is easily reflected.

Therefore, when the propagation path (reflection path) from the vibration plate 21 to the auxiliary opening 18*a* is correctly set, the sound that is emitted from the vibration plate 21 and propagates inside the housing 10 can be emitted from the auxiliary opening 18*a*. As described in the above embodiment, when the vibration plate 33 of the full-range speaker unit 31 is used as the sound emitting part and the vibration plate 21 which is the tweeter that emits a high-pitched sound of less than 2 kHz is used as the sound emitting part, the design of the propagation path from the sound emitting part to the auxiliary opening 18*a*, that is, the design of the inside of the housing 10 can be easily set.

The base reflex port 37 emits a sound toward the main opening 14*b* and does not emit a sound to the side opposite to the main opening 14*b*, and a mechanism for absorbing a sound emitted to the rear side of the vibration plate 21 is provided in the speaker device 20 which is a tweeter in many cases. Therefore, when the auxiliary opening 18*a* is provided in the base reflex port 37 or the vibration plate 21, preferably, the main openings 14*b* and 14*c* and the auxiliary opening 18*a* communicate with each other via the inside of the housing 10, and the sound from the base reflex port 37 or the vibration plate 21 is emitted from the auxiliary opening 18*a*.

In addition, it is not necessary for all of the auxiliary openings 18*a* to be located at the same position as the sound emitting part in the horizontal direction (the length direction of the corner 16), and at least a part of the auxiliary openings 18*a* may be located at the same position as the sound emitting part in the horizontal direction. Therefore, the sound emitted from the sound emitting part can be sufficiently and easily directed to the auxiliary opening 18*a*. In addition, when the center position of the plurality of auxiliary openings 18*a* in the horizontal direction is shifted in the horizontal direction with respect to the center position of the sound emitting part in the horizontal direction, the sound emitted from the auxiliary opening 18*a* can be easily spread in the shifted direction.

While a case in which the auxiliary opening 18*a* is provided in the lid part 18 has been described in the above embodiment, the disclosure is not necessarily limited thereto. The lid part 18 may be omitted and the through-hole 12*b* that penetrates through the upper and rear outer wall part 12*a* may be used as an auxiliary opening. In this case, the upper and rear outer wall part 12*a* and the guide 40 including the bottom part 41 and the diffusion part 42 may be integrally molded, and the guide 40 may be attached to the upper and rear outer wall part 12*a* by a bolt, an adhesive, or the like. However, when the guide 40 is integrally molded with the lid part 18, the through-hole 12*b* is provided in in the upper and rear outer wall part 12*a* of a conventional electronic keyboard musical instrument having no auxiliary opening 18*a* or the guide 40, and the lid part 18 is attached, and thus the auxiliary opening 18*a* and the guide 40 can be easily provided.

In addition, the bottom part 41 and the diffusion part 42 may project from the enclosure 36 of the speaker device 30 toward the rear panel 12. When the enclosure 36 is not used, for example, the bottom part 41 and the diffusion part 42 may project from the frame 32 toward the rear panel 12. Here, when the bottom part 41 projects from the rear panel 12, the angle θ formed by the inner surface of the rear panel 12 around the auxiliary opening 18*a* and the bottom part 41 can be easily set, and the bottom part 41 can be easily formed so that the an angle θ at which the sound reflected by the bottom part 41 can be easily guided to the auxiliary opening 18*a* is formed.

In addition, not only a case in which the diffusion part 42 rises from the bottom part 41, but also a case in which the bottom part 41 and the diffusion part 42 are arranged apart from each other may be used. Here, when the diffusion part 42 rises from the bottom part 41, since a space surrounded by the bottom part 41 and the diffusion part 42 is open toward the auxiliary opening 18*a*, the sound reflected by the bottom part 41 and the diffusion part 42 can be easily guided to the auxiliary opening 18*a*.

While a case in which the angle θ formed by the bottom part 41 and the inner surface of the lid part 18 (the inner surface of the second outer wall part) is less than 90° has been described in the above embodiment, the angle θ may be 90° or more. In addition, when the inner surface of the second outer wall part is curved, a configuration in which the angle formed by the bottom part 41 and a plane including the inner peripheral edge of the predetermined auxiliary opening 18*a* is less than 90° may be used.

While a case in which the diffusion part 42 is inclined (curved) with respect to the lid part 18 has been described in the first embodiment, and a case in which irregularities with the plurality of protrusions 63 is provided in the diffusion part 62 and thus the sound is easily irregularly reflected by the diffusion parts 42 and 62 has been described in the second embodiment, the disclosure is not necessarily limited thereto. In order for the sound to be easily irregularly reflected by the diffusion parts 42 and 62, a plurality of irregularities due to a plurality of recesses may be provided in the diffusion part 62, and a plurality of irregularities may be provided in the diffusion part 42 inclined with respect to the lid part 18. In addition, when stepped diffusion parts are formed so that at least a part of the diffusion parts is inclined in the horizontal direction with respect to the lid part 18, the sound can be easily irregularly reflected by the diffusion part.

In addition, a configuration as in the above electronic keyboard musical instrument 52 without providing irregularities such as the protrusions 63 in the diffusion part 62 may be used. The first inclined part 45 may be provided from the first end 43 to the second end 44, and the second inclined part 46 may be provided from the second end 44 to the first end 43. A part from the first inclined part 45 to the second end 44 may be formed perpendicular to the lid part 18, and a part from the second inclined part 46 to the first end 43 may be formed perpendicular to the lid part 18.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A sound emitting device, comprising:

a housing in which a corner is formed by an inner surface of a first outer wall part and an inner surface of a second outer wall part;

a speaker device which includes a sound emitting part that emits a sound toward a main opening formed to penetrate through the first outer wall part and is arranged inside the housing; and a guide that is arranged between the second outer wall part and the speaker device, wherein a plurality of auxiliary openings is provided to penetrate through the second outer wall part, and at least a part of the plurality of auxiliary openings is located at the same position as the sound emitting part in a length direction of the corner, and wherein the guide includes a bottom part that projects from one of the speaker device and the second outer wall part toward the other thereof.

2. The sound emitting device according to claim 1, wherein the auxiliary opening is positioned between the bottom part and the first outer wall part.

3. The sound emitting device according to claim 1, wherein in a cross section perpendicular to the length direction, an angle formed by the bottom part and a plane including an inner peripheral edge of the auxiliary opening inside the housing is less than 90°.

4. The sound emitting device according to claim 1, wherein the main opening and the auxiliary opening communicate with each other via an inside of the housing.

5. The sound emitting device according to claim 4, wherein the speaker device includes an enclosure in box shape having a facing surface part in which the sound emitting part is provided and faces the first outer wall part, and the sound emitting part is a vibration plate that divides the inside and an outside of the enclosure.

6. The sound emitting device according to claim 1, wherein the guide includes a plurality of diffusion parts that divides a space inside the housing between the bottom part and the plurality of auxiliary openings in the length direction, and the plurality of diffusion parts is provided to be arranged in the length direction.

7. The sound emitting device according to claim 6, wherein the diffusion part includes a first inclined part that is inclined to a center of the sound emitting part in the length direction from a first end on a side of the second outer wall part toward the speaker device.

8. The sound emitting device according to claim 6, wherein the diffusion part includes a second inclined part that is inclined to a center of the sound emitting part in the length direction from a second end on a side of the speaker device toward the second outer wall part.

9. The sound emitting device according to claim 8, wherein the sound emitting part is a vibration plate having an elliptical shape that is long in the length direction.

10. An electronic keyboard musical instrument, comprising:

a keyboard device in which a plurality of keys is arranged in a horizontal direction;

a housing having a first outer wall part that is arranged on one of a rear side and an upper side of the keyboard device and a second outer wall part that is arranged on the other of the rear side and the upper side of the keyboard device, wherein a corner is formed by an inner surface of the first outer wall part and an inner surface of the second outer wall part;

a speaker device which includes a sound emitting part that emits a sound toward a main opening formed to penetrate through the first outer wall part and is arranged inside the housing; and a guide that is arranged between the second outer wall part and the speaker device, wherein a plurality of auxiliary openings is provided to penetrate through the second outer wall part and at least a part of the plurality of auxiliary openings is located at the same position as the sound emitting part in the horizontal direction that is a length direction of the corner, and wherein the guide includes a bottom part that projects from one of the speaker device and the second outer wall part toward the other thereof.

11. The electronic keyboard musical instrument according to claim 10, wherein the auxiliary opening is positioned between the bottom part and the first outer wall part.

12. The electronic keyboard musical instrument according to claim 10, wherein in a cross section perpendicular to the horizontal direction, an angle formed by the bottom part and a plane including an inner peripheral edge of the auxiliary opening inside the housing is less than 90°.

13. The electronic keyboard musical instrument according to claim 10, wherein the main opening and the auxiliary opening communicate with each other via an inside of the housing.

14. The electronic keyboard musical instrument according to claim 13, wherein the speaker device includes an enclosure in box shape having a facing surface part in which the sound emitting part is provided and faces the first outer wall part, and the sound emitting part is a vibration plate that divides the inside and an outside of the enclosure.

15. The electronic keyboard musical instrument according to claim 10, wherein the guide includes a plurality of diffusion parts that divides a space inside the housing between the bottom part and the plurality of auxiliary openings in the horizontal direction, and the plurality of diffusion parts is provided to be arranged in the horizontal direction.

16. The electronic keyboard musical instrument according to claim 15, wherein the diffusion part includes a first inclined part that is inclined to a center of the sound emitting part in the horizontal direction from a first end on a side of the second outer wall part toward the speaker device.

17. The electronic keyboard musical instrument according to claim 15, wherein the diffusion part includes a second inclined part that is inclined to a center of the sound emitting part in the horizontal direction from a second end on a side of the speaker device toward the second outer wall part.

18. The electronic keyboard musical instrument according to claim 17, wherein the sound emitting part is a vibration plate having an elliptical shape that is long in the horizontal direction.

19. A sound emitting method, comprising:

providing a housing in which a corner is formed by an inner surface of a first outer wall part and an inner surface of a second outer wall part;

providing a speaker device which includes a sound emitting part that emits a sound toward a main opening formed to penetrate through the first outer wall part and is arranged inside the housing; and providing a guide that is arranged between the second outer wall part and the speaker device, wherein a plurality of auxiliary openings is provided to penetrate through the second outer wall part, and at least a part of the plurality of auxiliary openings is located at the same position as the sound emitting part in a length direction of the corner, and wherein the guide includes a bottom part that projects from one of the speaker device and the second outer wall part toward the other thereof.

20. The sound emitting method according to claim 19, wherein the auxiliary opening is positioned between the bottom part and the first outer wall part.

* * * * *